United States Patent [19]

Johnson

[11] Patent Number: 4,821,992

[45] Date of Patent: Apr. 18, 1989

[54] PICTURE HOOK WITH SAFETY CLOSURE

[76] Inventor: Dennis M. Johnson, 1125 S. 2nd St., Alhambra, Calif. 91803

[21] Appl. No.: 191,869

[22] Filed: May 9, 1988

[51] Int. Cl.[4] ..... A47G 1/16

[52] U.S. Cl. ..... 248/493; 248/306; 248/497

[58] Field of Search ..... 248/493, 497, 498, 306, 248/304, 301, 547; 294/82.2; 24/230.5, 236, 237; 40/617, 153

[56] References Cited

U.S. PATENT DOCUMENTS

| | | | |
|---|---|---|---|
| 1,554,391 | 9/1925 | Town | 248/306 X |
| 2,317,368 | 4/1943 | Frey | 248/493 |
| 2,418,111 | 4/1947 | Dahlander | 24/230.5 X |
| 2,787,435 | 4/1957 | Shields | 248/306 X |
| 3,003,214 | 10/1961 | Geraghty | 294/82.2 |
| 3,861,631 | 1/1975 | Shorin | 24/230.5 X |
| 4,440,432 | 4/1984 | Goris | 294/82.2 |
| 4,622,724 | 11/1986 | Dupre | 24/230.5 R X |

*Primary Examiner*—J. Franklin Foss
*Attorney, Agent, or Firm*—Bruce L. Birchard

[57] ABSTRACT

A picture hook with a controllable safety closure which prevents accidental dislodging of the picture or other object being suspended from the hook while, at the same time, permitting easy removal of the suspended object when such removal is desired.

4 Claims, 1 Drawing Sheet

PICTURE HOOK WITH SAFETY CLOSURE

BACKGROUND OF THE INVENTION

1. Field of the Invention

This invention relates to picture hooks and, more specifically, to picture hooks with a safety closure feature.

2. Prior Art

Search of the prior art in the United States Patent Office reveals several patents which disclose and claim picture hooks which are related to but do not anticipate salient features of the present invention. For example, U.S. Pat. No. 3,861,631 (Shorin) issued Jan. 21, 1975, shows a picture hook having a "wire trapping flap component". U.S. Pat. No. 2,539,825 (Genua) discloses a picture hanger with a locking hook. However, these patents fail to show or suggest a structure in which secured locking of the picture cord is achieved while at the same time permitting easy release of the locking feature so that the picture may be easily removed.

In times of earthquakes, large vertical motion may occur in the structure in which the picture hook is being used with the resultant dislodging of the hanger cord from the picture hanger and loss and possible destruction of valuable artistic or other artifact which was suspended from the particular picture hook in the structure suffering the effects of the earthquake. This was particularly true in California in a recent earthquake and this inventor decided that it would be desirable to develop some means for securing the picture cord in the picture hanger, while at the same time providing an easy means for release of the safety feature so that the picture or other artifact suspended from the picture hook could be easily removed, when desired.

Therefore, it is an object of this invention to overcome the shortcomings of prior art devices.

It is a further object of this invention to provide a picture hanger which secures the picture or other suspended artifact in place while, at the same time, permitting easy removal of the picture or artifact when such removal is desired.

SUMMARY OF THE INVENTION

According to the present invention, the picture hook or hanger is provided with a resilient locking device which terminates in proximity to the hook portion of the device. To the resilient locking portion there is attached a cord which exits the picture hook through a hole and a recess provided in the rear portion thereof, such cord permitting pulling of the locking portion or flap of the device so that sufficient space is provided to permit easy removal of the picture or picture cord from the hook or hanger.

BRIEF DESCRIPTION OF THE DRAWINGS

This invention and the fashion in which it provides a novel solution to prior art problems may best be understood by reading the specification which follows in conjunction with the drawings herein, in which.

DETAILED DESCRIPTION OF THE PREFERRED EMBODIMENT

Figure 1:
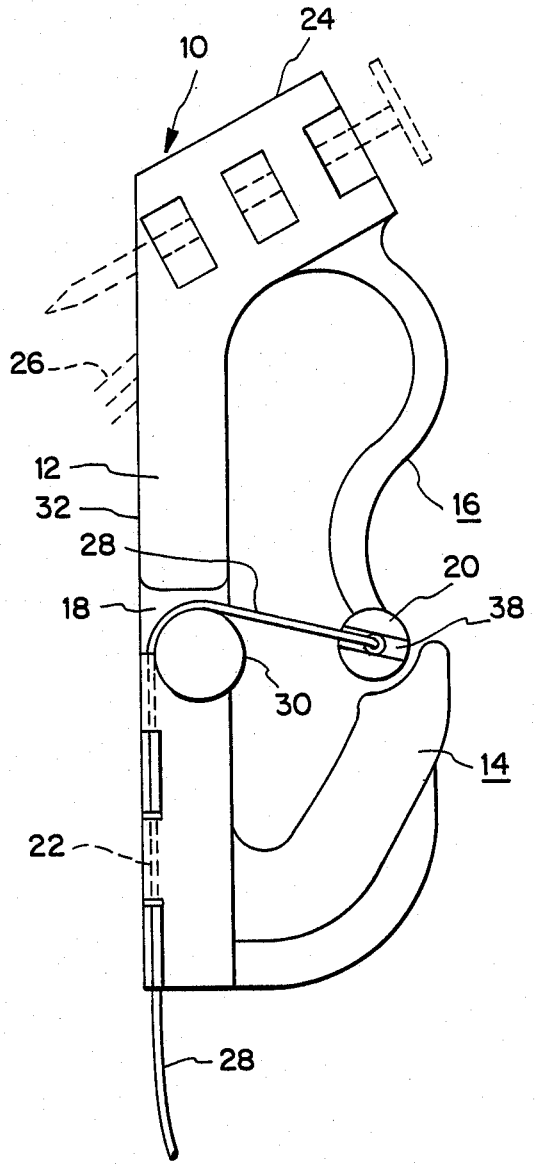
FIG. 1 is a side elevational view of a device according to my invention.
Figure 2:
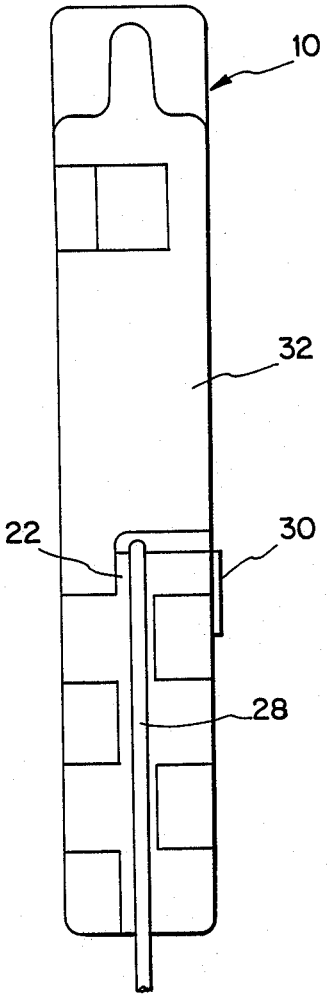
FIG. 2 is an end-elevational view of the novel picture hook of FIG. 1.

In FIG. 1 picture hook 10 includes a frame member 12 which carries a hook portion 14 at one extremity thereof and a locking portion 16 depending from the other extremity thereof. Frame portion 12 has an opening 18 passing therethrough. Locking portion 16 terminates in a knob portion 20 which is in close proximity to the extremity of hook portion 14 and is in opposition thereto. Knob portion 20 and its construction can be seen more clearly in FIGS. 3 and 4. Frame portion 12 has a recess 22 in the lower portion thereof, as can be seen more clearly from FIG. 2.

Frame 12, at the upper extremity thereof, has a nail receiving support member 24 which has a sloping aperture therethrough to receive an appropriate nail for securing picture hook 10 to a wall or other support member 26, which support member is not a part of this invention.

Picture hook 10 may be injection molded utilizing a product from E.I. DuPont & Co. called Delrin 300F. This material is inherently resilient and the dimensions of locking portion 16, which is made of the same material, are such that locking portion 16 is resilient and may be dislodged from its locking position to an unlocking position without fracturing locking member 16.

To effect the unlocking of picture hook 10 a cord 28 may be provided. Cord 28 is secured to knob 20 by means of a knotting structure shown more clearly in FIG. 3. Cord 28 may be of nylon or other long-lasting cord material. Cord 28 passes through opening 18 and through recess 22 in the back of picture hook frame member 12 and then exits below, as shown in FIG. 1. Recess 22 is provided to permit the exiting of cord 28 from picture hook 10 after passing over journal 30 so that picture hook 10 may have its rear wall 32 flush against the wall or other supporting member 26.

Figure 3:
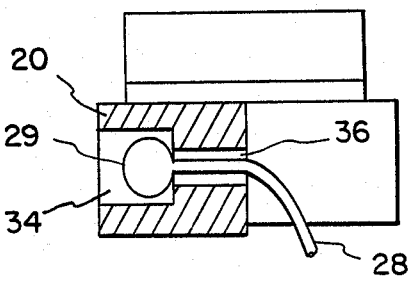
FIG. 3 is a partially sectioned view of a portion of the device of FIG. 1.
Figure 4:
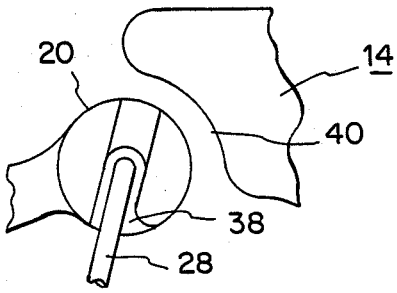
FIG. 4 is an enlarged view of a portion of the picture hook of FIG. 1.

The fashion in which cord 28 is secured in knob 20 may be seen more clearly in FIG. 3. In FIG. 3, cord 28, with its end 29 knotted, is passed through large opening 34 and narrow opening 36. It then passes towards journal 30, being guided by recess 38 in knob 20. Cord 28 passes over journal 30 and into channel or recess 22, shown in FIG. 1. When the remote end of cord 28 is pulled, it can be seen from FIG. 1 that knob 20 is pulled away from hook portion 14 permitting the picture cord or wire to be easily removed from hook portion 14. On the other hand, when cord 28 is released, knob 20 is in close proximity to hook portion 14, thus preventing the wire or cord which supports the picture or other hanging artifact from being shaken out of support by picture hook 10. Thus, in the event that there is a large vertical motion of the supporting member 26 as a result of a earthquake or, for example, if the supporting member 26 is part of an aircraft or ship, the picture or other artifact being supported is prevented from falling and injuring people or destroying itself. At the same time, if it is desired to remove the picture or artifact which is hanging from hook 10, that may be achieved easily by pulling on cord 28 (in a downward direction) and lifting the cord or wire of the picture or other artifact from hook portion 14 of picture hook 10.

While a particular embodiment of my invention has been shown and described, it will be apparent to those skilled in the art that variations and modifications may be made therein without departing from the spirit and scope of my invention. It is the intention of the appended claims to cover all such variations and modifications.

I claim:

1. A picture hook which includes a frame portion, a hook portion extending from said frame portion at one end thereof and a resilient locking portion extending from the remaining end of said frame portion;

said resilient locking portion being positioned in opposition to said hook portion and, in normal operation, in close proximity thereto;

a journal portion carried by said frame portion; and, a cord connected to said resilient locking portion, passing over said journal portion, through said frame portion and extending therefrom for manual operation of said resilient locking portion to move said resilient locking portion away from proximity with said hook portion, said frame portion carrying, at one end thereof, a nail receiving portion for securing said picture hook to a support member.

2. Apparatus according to claim 1 in which same frame portion has a channel for the free passage of said cord.

3. Apparatus according to claim 2 in which said frame portion includes, in addition, an aperture therethrough communicating with said recess in said frame portion for passage of said cord therethrough.

4. Apparatus according to claim 1 in which said frame portion, said hook portion and said locking portion are integral.

* * * * *